United States Patent [19]

Miller

[11] Patent Number: 4,800,518

[45] Date of Patent: Jan. 24, 1989

[54] DIFFERENTIAL CORRELATOR CIRCUIT

[75] Inventor: William J. Miller, North Miami, Fla.

[73] Assignee: Racal Data Communications, Inc., Fort Lauderdale, Fla.

[21] Appl. No.: 747,213

[22] Filed: Jun. 21, 1985

[51] Int. Cl.[4] ..... G06G 7/12

[52] U.S. Cl. ..... 364/819; 364/831

[58] Field of Search ..... 364/800, 807, 809–810, 364/819, 829–831, 861, 602, 604–605, 728, 733

[56] References Cited

U.S. PATENT DOCUMENTS

| | | | |
|---|---|---|---|
| 2,645,755 | 7/1953 | Garfield | 364/831 X |
| 3,076,933 | 2/1963 | Negrete | 364/831 X |
| 3,256,426 | 6/1966 | Roth et al. | 364/831 X |
| 3,333,091 | 7/1967 | Masak | 364/819 X |
| 3,478,268 | 11/1969 | Coviello | 325/65 |
| 3,700,876 | 10/1972 | Gray | 364/819 X |
| 3,906,213 | 9/1975 | Meriaux et al. | 364/819 X |
| 3,982,114 | 9/1976 | Hook | 364/819 X |
| 4,149,121 | 4/1979 | Gordy et al. | 325/321 |
| 4,164,628 | 8/1979 | Ward et al. | 179/15 BA |
| 4,209,834 | 6/1980 | Rabow | 364/604 |
| 4,317,204 | 2/1982 | Gordy et al. | 375/1 |

OTHER PUBLICATIONS

"Walsh Functions: A Digital Fourier Series," B. F. Jacoby; *Byte*, 1977, pp. 190–198.

"Line Coding for Digital Data Transmission," N. Q. Duc, et al., *Australian Telecommunications Review*, vol. 11, No. 2, 1977, pp. 14–27.

*Primary Examiner*—Gary V. Harkcom

*Attorney, Agent, or Firm*—Roberts and Quiogue

[57] ABSTRACT

A differential correlator for a receiver including a voltage controlled current source which is controlled by an input data signal which is based on a received signal. A switching circuit selectively couples the controlled current to one of two storage capacitors as a function of a reference signal. A comparison circuit compares the integrated voltages on the storage capacitors at the end of each integration period T to provide user data as a function of the comparison. A discharge circuit discharges the storage capacitors to a common initial voltage after the integrated voltages are compared.

5 Claims, 3 Drawing Sheets

DIFFERENTIAL CORRELATOR CIRCUIT

BACKGROUND OF THE INVENTION

1. Field of the Invention

The disclosed invention generally relates to correlation receivers, and is particularly directed to a differential correlation detector circuit.

2. Background Art

Correlating techniques have been recognized as powerful tools in signal processing, and have substantial utility in communications applications ranging from multiplexed communications to secure communications. Such signal processing is based on correlation of an information carrying signal with a reference signal. if the information signal is identified as S and the reference signal is identified as P, then the correlation function F over a time period T is as follows:

$$F = \int_0^T S \cdot P dt \qquad \text{(Equation 1)}$$

A specific application of the correlation function is a correlation detector wherein the information signal S is a received analog waveform and the reference waveform P is a known digital signal with a period T. In such a correlation detector, often only the sign of the function F over the period T is needed, thereby providing a binary output wherein positive indicates "one" and negative indicates "zero".

In synchronized systems the waveforms S and P are synchronized whereby they begin at the same time. However, the application of correlation detection extends to systems wherein S and P are not necessarily synchronized. More specifically, if the limit of integration is fixed to the start of the period of the waveform P and the waveform S is shifted in time relative to the waveform P, the function F can then be computed for a range of time shifts between the waveforms S and P. If the waveforms S and P are correlated (that is, the pattern of the signal S in some way resembles the pattern of the signal P) then the function F will be a maximum when the patterns coincide. Since the signals S and P are synchronized when they coincide, the function F is a maximum when the signals S and P are synchronized. Clearly, the foregoing process can be utilized to achieve synchronization between the signals S and P.

Further elaborating on the foregoing, one type of correlation detector utilizes what is known as the "spread spectrum" technique. In a particular class of spread spectrum transmitters, information D is multiplied by a digital signal (pattern) V to provide the transmitted signal TR.

$$TR = D \cdot V \qquad \text{(Equation 2)}$$

The pattern of binary ones and zeroes that form the digital signal V are typically defined by a predetermined code. The digital signal V has a period T, and the information D does not change during such period.

At the receiver, the information D can be recovered from a received signal S provided certain conditions are satisfied. An appropriate signal P is provided which satisfies the following:

$$P = V \qquad \text{(Equation 3)}$$

$$\int_0^T V \cdot V dt = 1 \qquad \text{(Equation 4)}$$

The received signal S is synchronized with the signal P, and the information D can be recovered by the correlation of S with P, provided that the information D is unchanged at the transmitter over each period T. Thus, the information D is provided by:

$$D = \text{sign} \int_0^T S \cdot D dt \qquad \text{(Equation 5)}$$

Common practice for accomplishing correlation detection includes the use of a four quadrant analog multiplier for multiplying the signals S and P, and an integration circuit for integrating the product of the signals over the integration period T. Such an integration circuit is often referred to as an "integrate and dump" circuit since the integration result of an integration interval must be discarded prior to integration over the next integration interval. The output of the integration circuit is sampled by an output amplifier at the end of the integration interval T. When only the sign of the integration output is desired, the output amplifier may be a comparator referenced to zero to detect sign.

Correlation circuitry for accomplishing multiplication and integration are generally complex and not readily adaptable to large scale integrated circuitry for a number of reasons.

Analog multipliers generally include operational amplifiers and logging transistors, and may include potentiometers to null the offset voltages of the logging transistors. Further, for known analog multipliers frequency compensation is difficult to achieve, and high speed operation is also difficult to achieve.

While the concept of integration over a period T is straightforward, implementation of integration circuitry is not. Typically, integration is accomplished with an operational amplifier configured as an integrator or with a gated current source. In any case, a capacitor integrates a controlled current, and the capacitor voltage at the end of the integration period is indicative of the integration result and is sampled. The capacitor voltage is then reset to a predetermined level for the next integration period.

Known integration circuits are typically single-ended integrators wherein a single capacitor integrates over any given integration period. Therefore, the capacitance values of the integration capacitors must be precisely achieved with absolute tolerances, which cannot be readily achieved with LSI techniques. Further, such single ended integration requires the use of bidirectional current sources which are difficult to implement. As a result, different techniques have been developed to accomplish positive and negative charging of an integration capacitor.

Also, known single-ended integration circuits exhibit sensitivity to temperature whereby different operating temperatures cause different integration results. Compensation for temperature sensitivity requires additional complicating circuitry.

Another disadvantage of known integration circuits, particularly those implemented with operational amplifiers, is that they cannot be readily utilized for high speed processing.

Since known correlation detection circuits generally include multipliers and integration circuits, they have the disadvantages of known multipliers and integration circuits. Thus, known correlation detection techniques are generally not readily adaptable to large scale integration, nor can they be utilized in very high speed applications. Moreover, because of complexity and unsuitability to integration, known correlation detection circuits are not readily utilized in applications which might advantageously utilize correlation detection but would require numerous correlation detection circuits in a single receiver. An example of such application would be a high speed multiplexed communications system.

Perhaps as a result of implementation difficulties, correlation techniques have not been widely utilized in communications, despite the recognition that correlation techniques are powerful signal processing tools.

SUMMARY OF THE INVENTION

It is, therefore, an object of the invention to provide a correlation detection circuit which is efficiently implemented utilizing large scale integrated circuit techniques.

It is also an object of the invention to provide a correlation detection circuit which does not require multiplier circuitry.

Another object of the invention is to provide a correlation detection circuit which does not utilize operational amplifiers.

Still another object of the invention is to provide a correlation detection circuit which utilizes differential integration capacitors.

A further object of the invention is to provide a correlation detection circuit having differential integration capacitors which do not require absolute tolerances.

It is also an object of the invention to provide a correlation detection circuit having integration circuitry that is insensitive to temperature changes.

Another object of the invention is to provide a correlation detection circuit which can operate at very high data rates including 50 megabits per second and higher.

Still another object of the invention is to provide a correlation detection circuit which can be utilized with a variety of codes.

A further object of the invention is to provide a correlation detection circuit which is readily utilized in a receiver requiring numerous correlation detection circuits.

The foregoing and other features of the invention are provided in a correlation detection circuit which includes a variable current source which provides a variable current as a function of the voltage of an input data signal, first and second storage capacitors for selectively integrating the variable current and for providing first and second integration signals, a switching circuit responsive to a reference signal for selectively coupling the input data signal to one of the first and second storage capacitors, comparator circuitry responsive to the first and second integration signals for providing a comparator output indicative of the difference between the first and second integration signals, and reset circuitry for resetting the first and second storage capacitors to substantially the same level.

BRIEF DESCRIPTION OF THE DRAWINGS

The advantages and features of the disclosed invention will be readily understood by persons skilled in the art from the following detailed description when read in conjunction with the drawing wherein.

DETAILED DESCRIPTION

Figure 1:
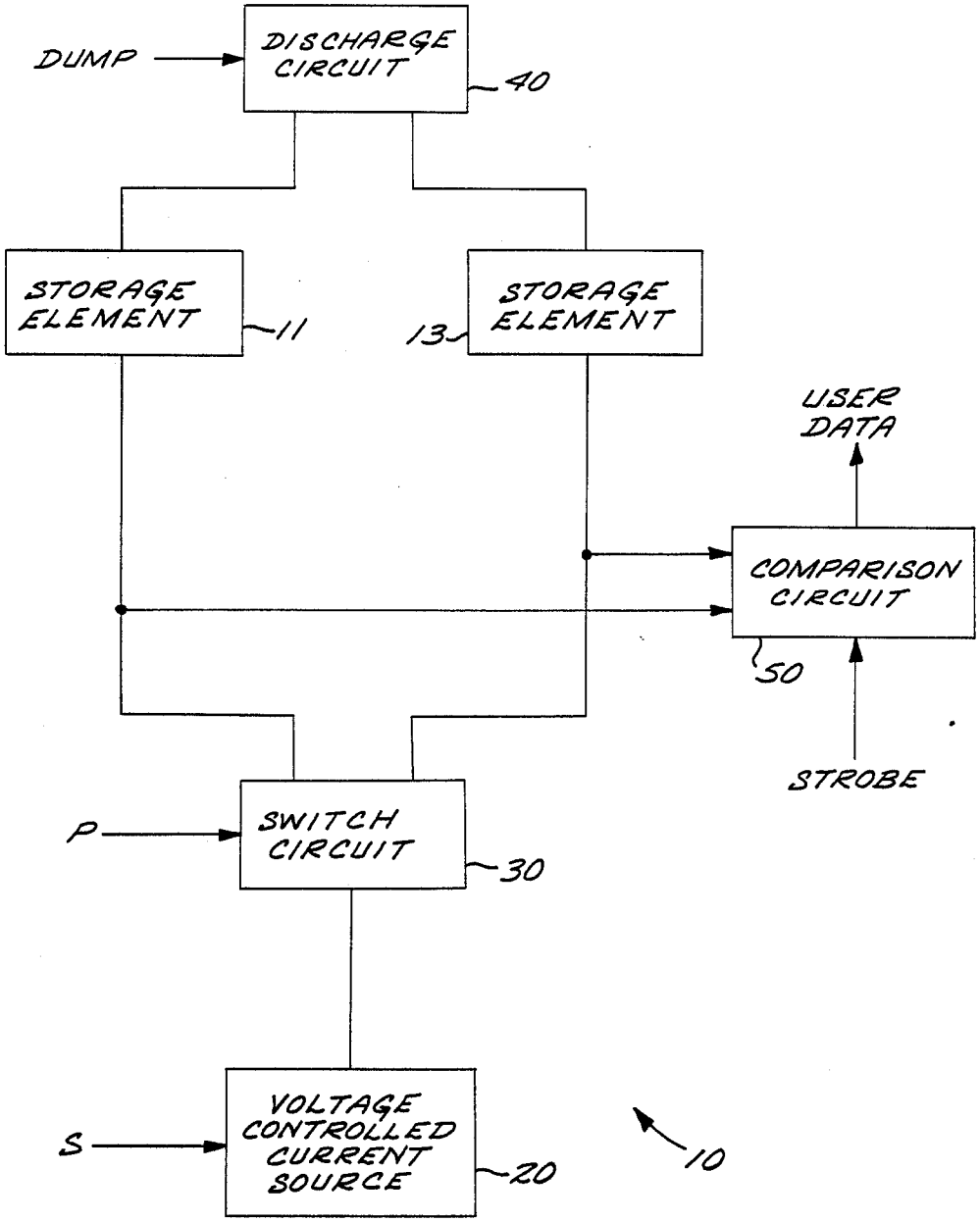
FIG. 1 is a block diagram of the major functional components of the disclosed differential correlation detector.

In the following discussion and in the several figures of the drawing, like elements will be identified with like reference numerals.

Referring now to FIG. 1, shown therein is a block diagram of the differential correlation detection circuit 10 of the invention which may be utilized in a receiver for a spread spectrum communication system. The inputs to the correlation detection circuit 10 and the data output of the correlation detection circuit 10 are regarded as being ECL compatible, except for the input data signal. ECL compatibility follows from the consideration that the disclosed invention is useful in very high speed applications. Of course, the invention may readily be embodied for other logic compatibility such as TTL.

The differential correlation detection circuit 10 includes a voltage controlled current source 20 which accepts as its controlling input an input data signal RS which is based on a signal received from a remote source. The correlation detection circuit 10 further includes a switch circuit 30 which is controlled by a reference signal P which is periodic with a period T and is orthogonal.

The reference signal P is a predetermined sequence, a replica of which is known to have been utilized at the remote source to generate for transmission a signal A which is included in a transmitted signal TR that is received by the receiver and utilized to provide the input data signal RS. The signal A based on the reference signal P may be just one component in the transmitted signal. Thus, the input data signal RS may be a composite signal from which the received component corresponding to the signal A is to be extracted. The disclosed differential correlation detection circuit 10 accomplishes the necessary extraction to the extent the input data signal RS includes a component that correlates with the reference signal P.

It should be pointed out that the received signal need not be substantially filtered to provide the input data signal RS. Thus, the received signal may be simply amplified for provision as the input data signal RS.

The reference signal P is generated locally and is synchronized to the input data signal RS. For example, many time-shifted versions of the reference signal P may be stored in memory and the one with the best correlation is utilized.

The switch circuit 30 couples the current source 30 to one of two storage elements 11 and 13 as a function of the polarity of the reference signal P. By way of example in the disclosed embodiment, the signal P is a digital signal of period T and which is ECL compatible. Thus, LO is represented by −5.2 volts and HI is represented by 0 volts.

The correlation detection circuit 10 further includes a discharge circuit 40 for discharging the storage elements to substantially identical initial levels of charge. A control signal DUMP controls the operation of the discharge circuit 40.

The respective outputs of the storage elements 11 and 13 are provided to a comparison circuit 50 which provides a USER DATA output signal that is a function indicative of the relative levels of charge between the storage elements 11 and 13. It is contemplated that the comparison circuit provided latched outputs which are enabled to change by a STROBE signal which occurs at the end of the period T prior to the occurrence of the DUMP signal. The USER DATA output of the comparison circuit 50 is the useful demodulated data output of the input data signal RS and is ECL compatible.

Figure 2:
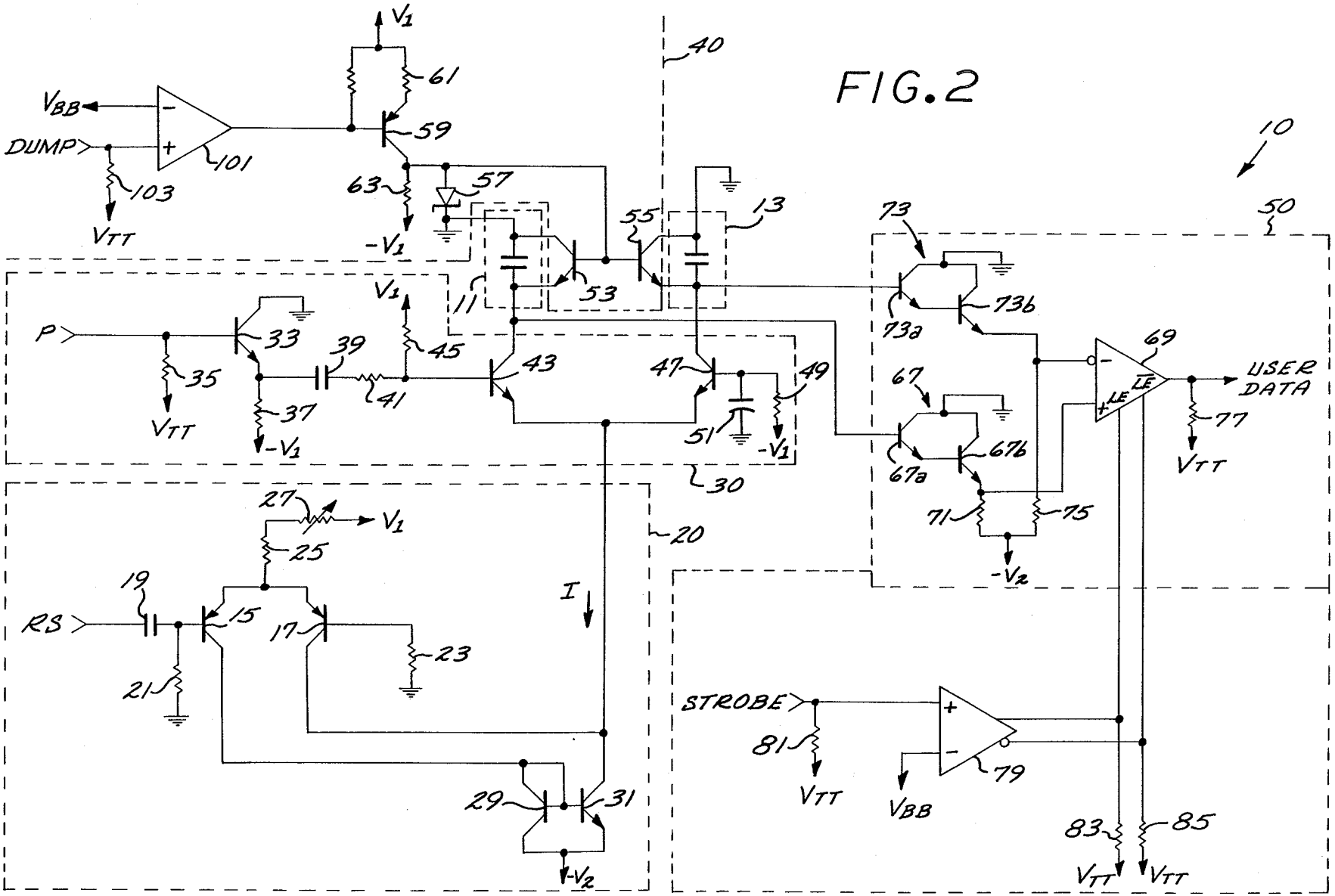
FIG. 2 is a schematic diagram of the disclosed differential correlation detector of FIG. 1.

Referring now to FIG. 2, the voltage controlled current source 20 includes a pair of transistors 15 and 17 which are connected in a differential amplifier configuration. The input data signal RS is applied to a DC blocking input capacitor 19 which is connected to the base of the transistor 15, thereby providing one input to the differential amplifier. A resistor 21 is connected between the base of the transistor 15 and ground. A resistor 23 is connected between the base of the transistor 17 and ground. Thus, the received signal RS provides a single-ended input to the differential amplifier formed by the transistors 15 and 17. The emitters of the transistors 15 and 17 are connected together and through a resistor 25 and a variable resistor 27 are coupled to a positive supply voltage V1 which by way of example is 5 volts.

The collectors of the transistors 15 and 17 are respectively connected to the collectors of a pair of transistors 29 and 31 which form a current mirror. Preferably, the transistors 29 and 31 are matched. The bases of the transistors 29 and 31 are coupled together and to the collector of the transistor 15. The emitters of the transistors 29 and 31 are coupled together to a negative supply voltage −V2 which by way of example is −12 volts.

The sum of the collector current $I_L$ of the transistor 15 and the collector current $I_R$ of the transistor 17 is a constant current $I_C$:

$$I_L+I_R=I_C \quad \text{(Equation 6)}$$

The time varying voltage of the input data signal RS relative to a steady state reference controls the current distribution between the collectors of the transistors 15 and 17. When the voltage of the input data signal RS goes negative relative to the steady state reference, the collector current $I_L$ of the transistor 15 increases, while the collector current $I_R$ of the transistor 17 decreases. When the voltage of the input data signal RS goes positive relative to the steady state reference, the collector current $I_R$ of the transistor 17 increases, while the collector current $I_L$ of the transistor 15 decreases.

The current distribution provided by the transistors 15 and 17 control the transistors 29 and 31 which operate in a non-saturated manner. Since the transistors 29 and 31 are preferably matched, as commonly done in integrated circuit practice, the base-emitter voltages of such transistors are substantially identical, and the collector currents are substantially the same. Assuming that the base currents of the transistors 29 and 31 are very small, then the current I provided by the voltage controlled current source is determined as follows:

$$I_L=I_R+I \quad \text{(Equation 7)}$$

$$I=I_L-I_R \quad \text{(Equation 8)}$$

Using Equation 5, the following equation is derived:

$$I=I_C-2I_R \quad \text{(Equation 9)}$$

Thus, when the voltage of the signal RS goes negative relative to the steady state reference, as described above, then the current I increases. When the voltage of RS goes positive relative to the steady state reference, as discussed above, then the current I decreases.

Specifically, the current I has a waveform that is shaped similarly to the voltage waveform of the input data signal RS, except that the current waveform is inverted. For example, if the signal RS is sinusoidal, then the current I would be sinusoidal. The current I further has a DC level that is not zero. By way of example, the DC level may be around 10 milliamps, and the swing of the current I in response to the input data signal RS may be several milliamps above or below the DC level.

The switch circuit 30 includes an input transistor 33 which is biased in an emitter follower configuration. A resistor 35 is coupled between a threshold bias voltage $V_{TT}$ and the base of the transistor 33. The reference signal P is applied to the base of the transistor 33 which has its collector coupled to ground. A resistor 37 is connected between the emitter of the transistor 33 and a negative supply voltage −V1 which by way of example is −5 volts. A capacitor 39 and resistor 41 are serially connected between the emitter of the transistor 33 and the base of a transistor 43. The base of the transistor 43 is also connected to the positive supply voltage V1 through a resistor 45. The emitter of the transistor 43 is connected to the emitter of a transistor 47 as well as to the collector of the transistor 31. The base of the transistor 47 is coupled via a resistor 49 to the negative supply voltage −V1, and is also connected to one end of a capacitor 51 which is connected to ground.

The transistors 43 and 47 form a differential pair and preferably are matched as is commonly done in integrated circuit technology. In operation, when the reference signal P is HI, the transistor 43 will be conductive while the transistor 45 is non-conductive. When the reference signal P is LO, the transistor 47 will be conductive and the transistor 43 will be non-conductive. Thus, the transistors 43 and 47 perform a switching operation as a function of the reference signal P.

The storage elements 11 and 13 are storage capacitors as shown in FIG. 2, and each capacitor has one side coupled to ground. The non-grounded side of the capacitor 11 is connected to the collector of the transistor 43, and the non-grounded side of the capacitor 13 is connected to the collector of the transistor 47. Thus, the capacitors 11 and 13 will be selectively coupled to the voltage controlled current source 20 by the switch circuit 30. The capacitor that is coupled to the current source 20 will tend to charge to an increasingly negative voltage.

The discharge circuit 40 includes a pair of transistors 53 and 55 which have base terminals that are commonly connected to the cathode of a Schottky diode 57 which has its anode connected to ground. Preferably, the transistors 53 and 55 are matched. The transistor 53 has it collector connected to the grounded side of the capacitor 11 and its emitter connected to the non-grounded side of the capacitor 11. The transistor 55 has its collector connected to the grounded side of the capacitor 13 and its emitter connected to the non-grounded side of the capacitor 13. When the transistors 53 and 55 are rendered simultaneously conductive by the signal applied to their base terminals, the capacitors 11 and 13 are discharged so that their non-grounded sides achieve substantially equal voltages of slightly less than the ground reference. When the transistors 53 and 55 are non-conductive, the capacitors 11 and 13 will charge under the control of the switch control 30 and the voltage controlled current source 20.

The discharge transistors 53 and 55 are controlled by the collector output of a PNP transistor 59. A resistor 61 is connected between the collector of the transistor 59 and the positive supply voltage V1. The emitter of the transistor 59 is coupled to the negative supply voltage -V1 via a resistor 63, and the base of the transistor 59 is coupled to the positive supply voltage V1 via a resistor 65.

The PNP transistor 59 is controlled by the output of an ECL to TTL translator 101 which accepts the control signal DUMP at its non-inverting input, which is also coupled through a resistor 103 to the threshold bias voltage $V_{TT}$. The inverting input of the ECL to TTL translator 101 is coupled to a base bias voltage $V_{BB}$. Since the translator 101 is set up to be non-inverting, when the control signal DUMP signal is LO (e.g., −5.2 volts), the translator output is also LO (e.g., 0 volts). When the control signal DUMP signal is HI (e.g., 0 volts), the translator output is also HI (e.g., 5 volts). By way of example, the ECL to TTL translator may be implemented with a commercially available integrated circuit such as the Motorola MC10125.

When the control signal DUMP causes a narrow positive pulse to be applied the base of the PNP transistor 59, it becomes conductive. The discharge transistors 53 and 55 will then be rendered conductive to discharge and initialize the storage capacitors 11 and 13 to a substantially common level.

The comparison circuit 50 includes a first Darlington amplifier 67 which includes the transistors **67*a* and 67*b*. The input to the Darlington amplifier 67 is provided by the non-grounded side of the capacitor 11. The output of the Darlington amplifier 67 is coupled to the non-inverting input of a latching comparator 69. A resistor 71 is connected between the emitter of the transistor 67*b* and the negative supply voltage −V2. The collectors of the transistors 67*a* and 67*b*** are tied to ground.

The comparison circuit 50 further includes a second Darlington amplifier 73 which includes the transistors **73*a* and 73*b*. The input to the Darlington amplifier 73 is provided by the non-grounded side of the capacitor 13. The output of the Darlington amplifier is coupled to the inverting input of the latching comparator 69. A resistor 75 is connected between the emitter of the transistor 73*b* and the supply voltage −V2. The collectors of the transistors 73*a* and 73*b*** are tied to ground.

The Darlington amplifiers 67 and 73 function as high impedance buffers to prevent discharge of the hold capacitors 11 and 13 by the voltage comparator 69. Alternatively, FET buffers could be utilized.

The output of the latching comparator 69 is coupled through a resistor 77 to the threshold bias voltage $V_{TT}$, and provides the USER DATA signal. By way of example, the latching comparator 69 may be a commercially available AMD Am 687 comparator which provides complementary outputs that are compatible with most forms of ECL. The AMD Am 687 comparator includes complementary latch enable inputs which are intended to be driven by complementary ECL signals. Therefore, the latching comparator 69 is shown as receiving at its latch enable inputs LE and $\overline{LE}$ latch enable signals from a line receiver 79 which by way of example may be a commercially available Motorola MC10116. The line receiver 79 has a differential input wherein the non-inverting input receives the STROBE signal and is coupled through a resistor 81 to the threshold bias voltage $V_{TT}$. The inverting input is coupled to the base bias voltage $V_{BB}$.

The non-inverted output of the line receiver 79 is coupled to the latch enable input LE of the comparator 69 and to one end of a resistor 83 which has its other end connected to the threshold bias voltage $V_{TT}$. The inverted output of the line receiver 79 is coupled to the latch enable input $\overline{LE}$ of the comparator 69 and also to one end of a resistor 85 which has its other end connected to the threshold bias voltage $V_{TT}$.

When the STROBE signal is HI, then the line receiver 79 non-inverted output is HI and the line receiver 79 inverted output is LO. That condition will enable the comparator 69 to function normally. When the STROBE signal is LO, the line receiver 79 provides a LO non-inverted output and a HI inverted output. The occurrence of that condition would lock the comparator output to its existing logical state. Thus, when the STROBE signal goes HI, the comparator output is a function of the inputs; and when the STROBE signal goes LO, the comparator output is locked to the state that existed at the time the STROBE signal was driven LO.

Figure 3:
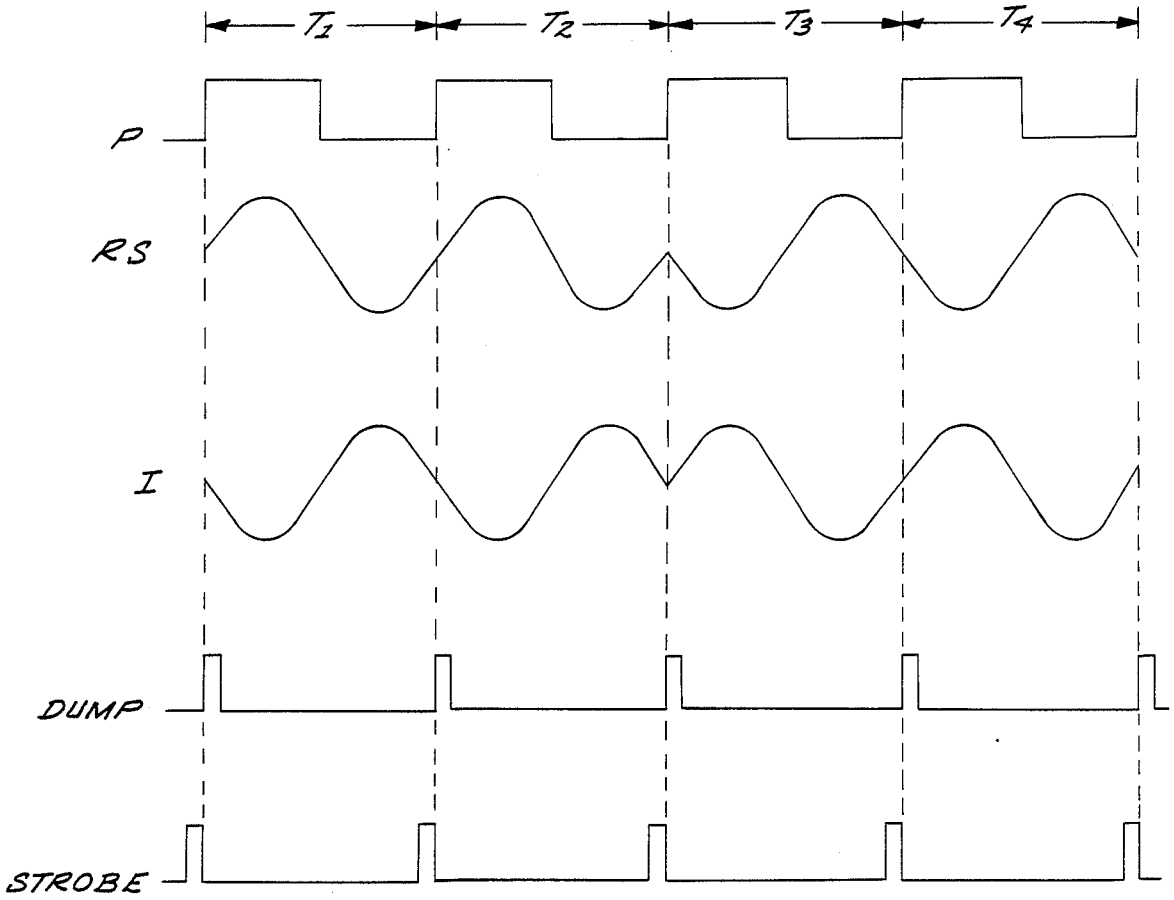
FIG. 3 is a timing diagram showing the relative timing relationships of the major signals of the differential correlation detector of FIGS. 1 and 2.

The operation of the differential correlation circuit 10 can be further understood with reference to the timing diagram of FIG. 3. The predetermined reference signal P is shown as a square wave having a 50% duty cycle and a period T. For ease of reference and understanding, the input data signal RS is shown as a sinusoidal signal having the same period T and which is in phase with the signal P for the time intervals T1 and T2. During the time intervals T3 and T4, the input data signal RS is 180 degrees out of phase relative to the reference signal P. The current I has a waveform that is the inverse of the signal data signal RS.

As discussed earlier, the input data signal RS may be a composite signal which includes an information carrying component which is correlated with the reference signal P.

At the beginning of the interval T1, a positive going DUMP pulse causes the storage capacitors 11 and 13 to be discharged to a common voltage level; and the signal P goes HI causing the transistor 43 to conduct. After the DUMP pulse is removed, the storage capacitor 11 integrates the current I until the signal P goes LO in the middle of the interval T1. The transistor 47 then becomes conductive and the storage capacitor 13 integrates the current I. At the end of the interval T1, the STROBE pulse caused the voltage comparator 69 to provide a USER DATA signal output indicative of the difference $V_{diff}$ between the voltage on the capacitor 11 (VC1) and the voltage on the capacitor 13 (VC2):

$$V_{diff} = VC1 = VC2 \qquad \text{(Equation 10)}$$

If $V_{diff}$ is positive, then the USER DATA signal output of the comparator 69 is HI. If $V_{diff}$ is negative, then the USER DATA signal output is LO. Stated another way, the comparator 69 output is HI when the voltage VC1 on the capacitor 11 is greater; and the comparator 69 output is LO when the voltage VC2 on the capacitor 13 is greater.

During the time interval T1, the capacitor 13 will be charged more negatively than the capacitor 11 since the current I is greater when the capacitor 13 is charging. Therefore, the comparator 69 will provide a HI output pursuant to the STROBE pulse. The integration during the time interval T2 will also result in a HI output pursuant to the STROBE pulse at the end of such time interval.

Thus, where the input signal RS is sinusoidal and in phase with the signal P over the period T, the user data will be HI.

During the time interval T3, capacitor 11 will be charged more negatively than the capacitor 13 since the current I is greater when the capacitor 11 is charging. Therefore, the comparator 69 will produce a LO output pursuant to the STROBE pulse. Similarly, the integration during the time interval T4 will produce a LO output pursuant to the STROBE pulse at the end of such time interval.

Thus, where the input signal RS is sinusoidal and 180 degrees out of phase relative to the predetermined signal P over the period T, the USER DATA signal will be LO.

From the foregoing, it is readily evident that a predetermined reference signal P that is a square wave can be utilized to detect serial binary data that is represented by a sinusoidal voltage having the same period or frequency as the square wave. It should also be apparent that the predetermined reference signal P can have other patterns. The differential correlator 10 will demodulate an input data signal having the same sequence as the reference signal P.

Preferably, the reference signal P should be chosen so that each of the transistors 43 and 47 are on for substantially the same amount of time over the period T. Thus, for each period T, each transistor is on for a total time of T/2. As discussed previously, the reference signal P should be periodic with a period T and should also be orthogonal. Known codes which have the foregoing properties include the Walsh codes, except for the DC Walsh code.

The foregoing disclosure has been directed to a correlation detection circuit which does not utilize multiplier circuitry or operational amplifiers. Further, the disclosed correlation detection circuit does not require absolute tolerances for the integration capacitors since they are utilized differentially. As a result of these and other features, the disclosed correlation detection circuit is readily implemented with LSI circuitry. It should be noted that the integration capacitors preferably should track with temperature change, which can be readily achieved with LSI techniques.

As a further result of not utilizing operational amplifiers, the disclosed correlation detection circuit is capable of very high speed operation. Data rates of 50 megabits and higher can be achieved.

Since the disclosed correlation detection circuit does not utilize multiplication and integration in the traditional manner to provide the correlation function, it may be helpful to consider the disclosed correlation detection circuit as providing correlation in a more direct manner. It determines whether a component of the input data signal has a waveform that resembles the reference signal waveform.

Although the foregoing has been a description and illustration of specific embodiments of the invention, various modifications and changes thereto can be made by persons skilled in the art without departing from the scope and spirit of the invention as defined by the following claims.

What is claimed is:

1. A correlation detection circuit comprising:

means responsive to an input data signal for providing a controlled signal as a function of the input data signal;

first and second storage means for selectively integrating said controlled signal and for providing first and second integration signals;

switching means responsive to a single reference signal for selectively coupling said controlled signal to said first and second storage means as a function of the reference signal, said switching means including differentially coupled transistors having their emitters coupled together for receiving said controlled signal and having respective collectors respectively coupled to said first and second storage means; and comparator means responsive to said first and second integration signals for providing a comparator output indicative of the difference between said first and second integration signals.

2. A correlation detection circuit comprising:

input means responsive to an input data signal for providing a controlled signal as a function of the input data signal; and differential integrating means for integrating said controlled signal as a function of a single two-state reference signal over a period T and for providing an integration output indicative of the difference between integration when said reference signal is in a first state and integration when said reference signal is in a second state, said differential integrating means including:

(a) first and second accumulating means selectively responsive to said controlled signal and for providing first and second integration signals as said integration output; and (b) switching means responsive to the two-state reference signal for coupling said controlled signal to said first accumulating means in response to the first state of the reference signal and for coupling said controlled signal to said second accumulating means in response to the second state of the reference signal.

3. The correlation detection circuit of claim 2 wherein said differential integrating means further includes:

comparator means responsive to said first and second integration signals for providing a logical output indicative of the difference between said first and second integration signals.

4. A correlation detection circuit for receiving an input data signal and a single reference signal, comprising:

a voltage controlled current source responsive to the input data signal for providing a variable current as a function of the input data signal; and means for differentially integrating said variable current over a period T as a function of the reference signal to provide a differential integration output indicative of the correlation between the input data signal and the reference signal, said differentially integrating means including:

(a) first and second accumulating means selectively responsive to said variable and for providing first and second integration signals as said differential integration output; and (b) switching means responsive to the reference signal for coupling said variable to said first accumulating means or to said second accumulating means as a function of the value of the reference signal.

5. The correlation detection circuit of claim 4 wherein said means for differentially integrating further includes:

comparator means responsive to said first and second integration signals for providing a logical output indicative of the difference between said first and second integration signals.

* * * * *